US006167601B1

(12) United States Patent
Gollhofer et al.

(10) Patent No.: US 6,167,601 B1
(45) **Date of Patent: *Jan. 2, 2001**

(54) METHOD FOR MANUFACTURING VENTILATED SHEET-METAL FLOOR MEMBERS

(75) Inventors: David Gollhofer, Mt. Pleasant; Brad E. Smithburg, Salem, both of IA (US)

(73) Assignee: Conrad American, Houghton, IA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/542,967

(22) Filed: Sep. 22, 1995

(Under 37 CFR 1.47)

(51) Int. Cl.[7] ..... B21D 31/04

(52) U.S. Cl. ..... 29/6.1; 72/186; 83/37; 83/345

(58) Field of Search ..... 72/186; 83/37, 83/345; 29/6.1

(56) References Cited

U.S. PATENT DOCUMENTS

| | | | | |
|---|---|---|---|---|
| Re. 31,368 | | 9/1983 | Trumper . | |
| 3,433,044 | * | 3/1969 | Rhodes et al. | 72/186 |
| 4,137,682 | | 2/1979 | Trumper . | |
| 4,170,122 | * | 10/1979 | Cowell | 72/186 |
| 4,297,866 | * | 11/1981 | Sakauye et al. | 72/186 |
| 4,418,558 | | 12/1983 | Simmons . | |
| 4,649,607 | * | 3/1987 | Kuhn, II | 29/6.1 |
| 5,375,446 | * | 12/1994 | Hew | 72/186 |
| 5,509,288 | * | 4/1996 | Ohno et al. | 72/186 |

* cited by examiner

*Primary Examiner*—P. W. Echols
(74) *Attorney, Agent, or Firm*—Kinney & Lange, P.A.

(57) ABSTRACT

A method of manufacturing interlocking sheet metal floor members for use in a grain storage bin or like application requiring passage of fluid through the floor members without permitting passage of granular material therethrough. The method comprises the steps of forming a first interlocking section on a first side edge of a strip of sheet metal and a second interlocking section on a second side of the strip of sheet metal; shearing, opening and corrugating the strip of sheet metal in one roll forming stand which utilizes a pair of shearing and corrugation rollers, wherein the shearing step includes shearing rows of slits across a width of a central portion of the strip of sheet metal, wherein the opening step includes opening the slits to permit fluid flow therethrough, and wherein the corrugating step includes corrugating the strip of sheet metal along each of the series of the slits; and cutting the strip of sheet metal at selected transverse locations to form the sheet metal floor members. The first interlocking section of one sheet metal floor member is interlockable with the second interlocking section of another sheet metal floor member.

7 Claims, 4 Drawing Sheets

70
76
80
78
74

82
78
76
80
74
72

54
63
66
64
62

54
66
66
64
60
62
64
63

82
78
74
80
72
79

63
64
62
54
66
60
69

METHOD FOR MANUFACTURING VENTILATED SHEET-METAL FLOOR MEMBERS

BACKGROUND OF THE INVENTION

The present invention relates to a floor system for a grain storage bin or like application, and, more particularly, to a method and apparatus for making a floor system for grain storage bins utilizing interlocking, ventilated, sheet-metal floor members.

Sheet-metal grain storage bins are used for both short term and long term storage of a wide variety of different grains. Grain storage bins of this type ordinarily include a sheet-metal housing, an elevated perforated sheet-metal floor, and a fan for blowing air into the space below the floor so that the air flows upwardly through the floor into the grain. The floor is made up of a plurality of elongated perforated floor members of generally channel-like cross-sectional configuration which interlock with each other to form a continuous floor. The floor may be supported on a variety of different kinds of support members. Usually, the support members are free standing sheet-metal support legs. Examples of grain bin flooring systems of this general kind are described in Simmons U.S. Pat. No. 4,418,558, and Trumper U.S. Pat. No. 4,137,682.

Floor members for grain storage bins are typically constructed using a roll forming machine. A strip of sheet metal having prefabricated ventilation holes drilled or punched therein is then fed into the machine from a roll stock. The prefabricated strip with ventilation holes therein is then fed through a preforming stand for making the interlocking side sections. Next, the strip is fed through a corrugation stand to form the corrugations in association with the prefabricated ventilation holes. Finally, the strip is fed through a final forming stand for arching or crowning the top surface of the floor to increase the strength of the floor because the removal of material for the ventilation slots weakens the material. There are several disadvantages with this method which include the added step of drilling or punching the ventilation holes or the extra cost of purchasing pre-punched strip sheet metal, the disposal of the wasted material from the drilling or punching of the ventilation holes, the loss of strength in the floor due to the removal of material to form the ventilation holes, and the added fabrication step of having to arch or crown the top of the floor to compensate for the loss in strength.

The Simmons U.S. Pat. No. 4,418,558 teaches a method of manufacturing a grain bin sheet metal floor which includes processing a continuous roll of sheet metal through a preliminary shaping stand for making the interlocking side walls, a lancing stand for making closed slits in the sheet metal a corrugation stand separate from the lancing stand for opening the slits and forming corrugations in the sheet metal, and a finishing stand for arching the floor member. A cut-off machine then cuts the continuous sheet metal into the desired lengths constituting the individual floor members. This method still has the disadvantage of having separate stations for lancing and corrugating the material.

SUMMARY OF THE INVENTION

The present invention defines an improved method of manufacturing interlocking sheet metal floor members for use in a grain storage bin or like application requiring passage of fluid through the floor members without permitting passage of granular material therethrough. The method comprises the steps of forming a first interlocking section on a first side edge of a strip of sheet metal and a second interlocking section on a second side of the strip of sheet metal. The next step is shearing, opening and corrugating the strip of sheet metal in one roll forming stand using one set of rollers, wherein the shearing step includes shearing rows of slits across a width of a central portion of the strip of sheet metal, wherein the opening step includes opening the slits to permit fluid flow therethrough, and wherein the corrugating step includes corrugating the strip of sheet metal along each of the series of the slits. The final step is cutting the strip of sheet metal at selected transverse locations to form the sheet metal floor members. The first interlocking section of one sheet metal floor member is interlockable with the second interlocking section of another sheet metal floor member.

The present invention provides a shearing and corrugation stand for a continuous roll forming machine for use in making sheet metal floor members. The shearing and corrugation stand comprises a first roller and a second roller. The first roller has a plurality of shear blades each of which is arranged transversely and parallel to each other around a periphery of the first roller. Each of the plurality of shear blades having a first side section and a second side section. The first and second side sections each have recesses therein to form shearing teeth for cutting slits in the sheet metal. The shearing teeth of the first and second side sections are alternately displaced with respect to each other so that a tooth on one section is opposite a recess of the other section. The second roller has a plurality of shear blades each of which is arranged transversely and parallel to each other around a periphery of the second roller. Each of the plurality of shear blades has a first side section, and a second side section. The first and second side sections each have recesses therein to form shearing teeth for cutting slits in the sheet metal. The shearing teeth of the first and second side sections are alternately displaced with respect to each other so that a tooth on one section is opposite a recess of the other section. The shearing blades of the first roller are arranged to mesh with the shearing blades of the second roller to cut and open slits in the sheet metal and at the same time form corrugations in the sheet metal.

DETAILED DESCRIPTION OF THE PREFERRED EMBODIMENTS

Figure 1:
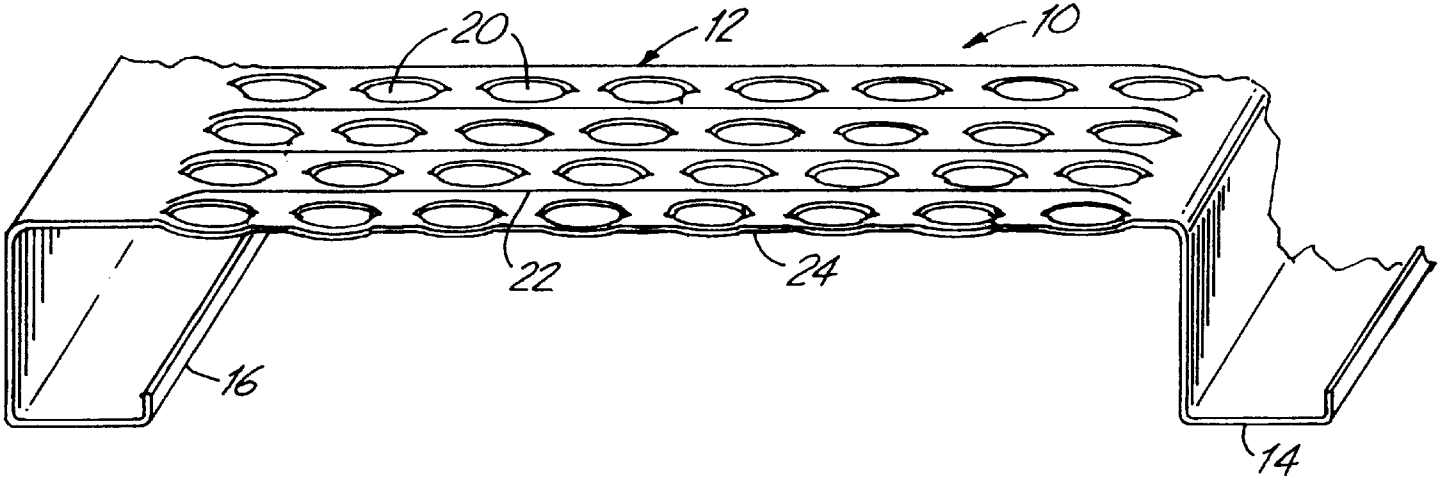
FIG. 1 is a prospective view of a segment of a typical floor member for use in a grain storage bin or like application, the floor member being manufactured in accordance with the method and apparatus of the present invention.

FIG. 1 illustrates one end segment of a floor member 10 manufactured in accordance with the method and apparatus of the present invention. The floor member 10, which may be of any desired length, includes a central floor surface portion 12 formed integrally with a depending male support channel 16 at one side of the floor member 10 and a depending female support channel 14 at the opposite side of the floor member 10. When the floor is installed, the male support channel 16 of the floor member fits into the female support channel 14 of an adjacent similar floor member and both are engaged by a free-standing sheet-metal floor support (not shown) that maintains an air space or plenum below the floor. The free standing floor support is well known to those having ordinary skill in the art.

The central floor surface portion 12 of the floor member 10 is preferably of horizontal construction, and includes a multiplicity of narrow ventilation slots 20. The central portion of the floor member is also formed in a series of transverse corrugations having peaks 22 and valleys 24. The corrugations extend parallel to the direction of the slots 20. In a preferred construction, as illustrated, the ventilation slots 20 are located intermediate of the corrugations peaks 22 and valleys 24, or in other words on the slopes of the corrugations, but it is not essential that this alignment be preserved throughout the floor member 10.

The floor member 10 is formed of sheet-metal which is preferably a galvanized sheet-steel. Typically, the stock from which floor member 10 is fabricated comprises galvanized sheet-steel having a thickness of approximately 0.038 to 0.039 inch. This material is strong enough for most applications. Of course, a heavy or lighter sheet-metal stock may be employed, depending upon end use requirements.

Figure 2:
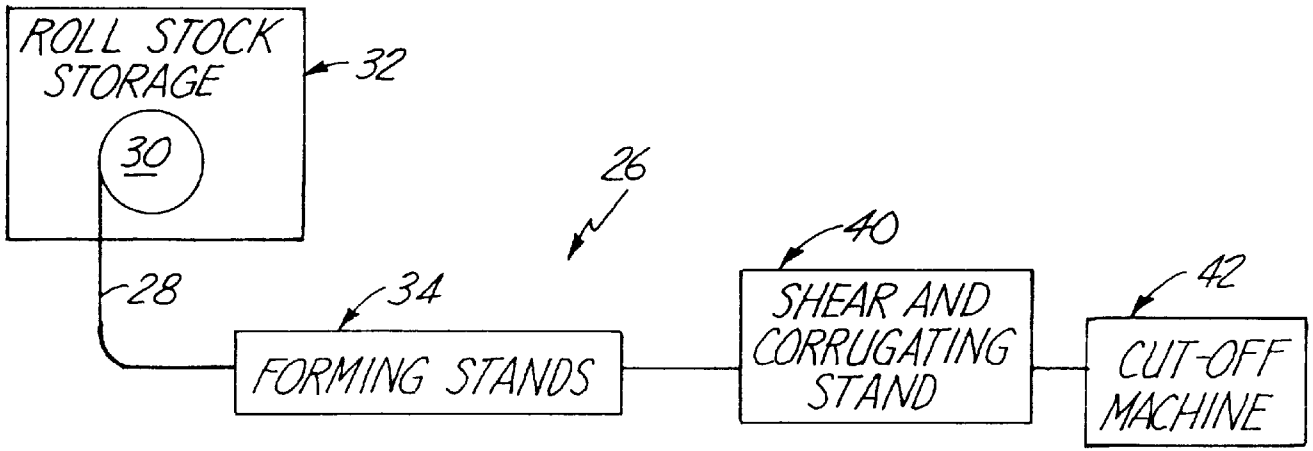
FIG. 2 is a schematic block diagram illustrating a roll forming machine which performs the basic steps of manufacturing a floor member in accordance with the present invention.

FIG. 2 illustrates a roll forming machine 26 according to the present invention for use in fabricating the floor member 10 utilizing a continuous roll of sheet-metal. Flat sheet-metal stock is fed as a strip 28 from a roll 30 in a roll storage station 32 into a preliminary forming stands 34 of the roll forming machine 26. The preliminary forming stands 34 are used to shape the support channels 14 and 16 along the edges of the sheet-metal strip 28.

As strip 28 emerges from the preliminary forming stands 34, the strip 28 retains a flat central portion that will ultimately form the central floor surface portion 12 of a completed floor member 10 (see FIG. 1). In this condition the sheet-metal strip 28 is fed into the shearing and corrugating stand 40 in accordance with the present invention. The shearing and corrugation stand 40 uses a pair of rollers or drums 42 and 44 (shown in FIGS. 3 and 4 and discussed below), each of which has blades which shear and open the ventilation slots 20 and at the same time provides the corrugation on the central floor surface portion 12 of the floor member 10. The shape of the blades (as further explained below) allows the strip 28 to simultaneously be formed into the corrugations while the ventilation slots 20 are cut and opened. As the completely formed floor member strip 28 emerges from the shear and corrugating stand 40, a cut-off machine 42 slices desired lengths, constituting the individual floor members 10. The shearing and corrugation stand 40 may be retrofitted into an existing roll forming machine such as, for example, roll forming machine Model No. M2½-24-9 which is available from the Bradbury Company Inc. of Moundridge, Kans. 67107. In this arrangement, the corrugation stand of the Model No. M2½-24-9 is replaced with the shearing and corrugation stand 40 of the present invention.

Figure 3:
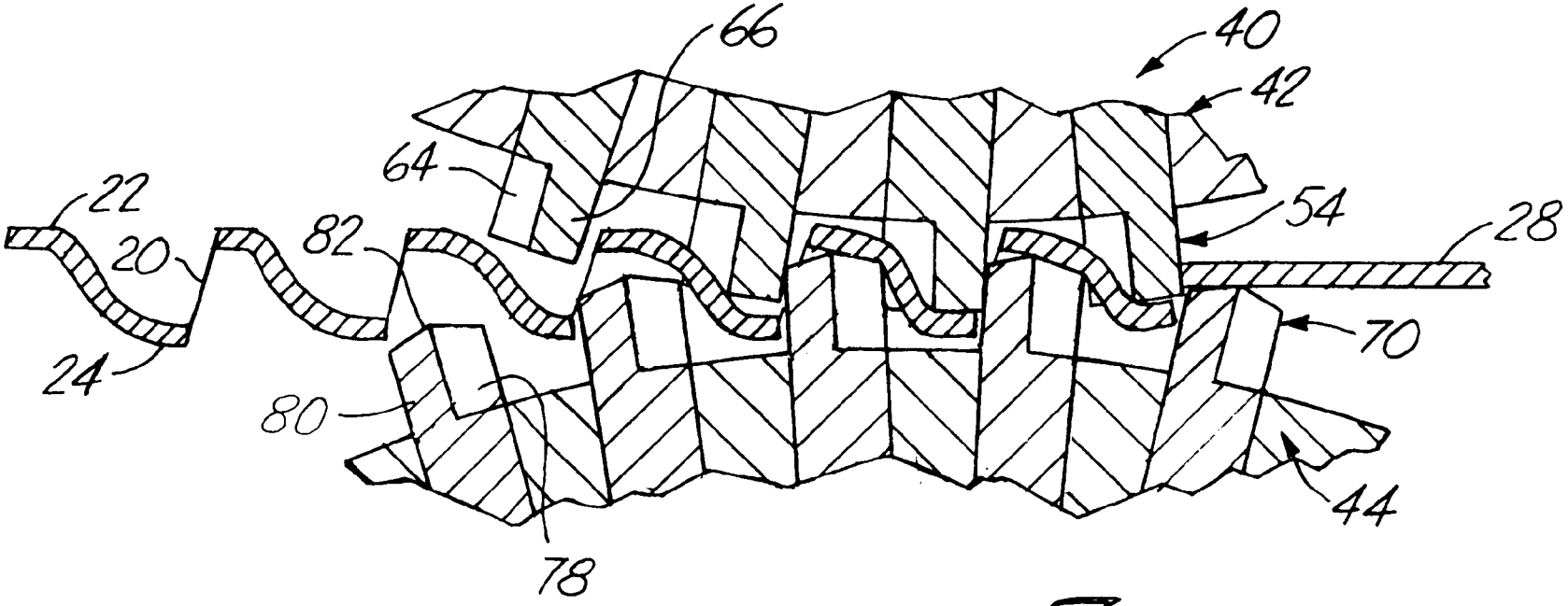
FIG. 3 is a sectional drawing illustrating the slitting, opening and corrugation of the sheet-metal in a single stage of the roll forming machine in accordance with the present invention.
Figure 4:
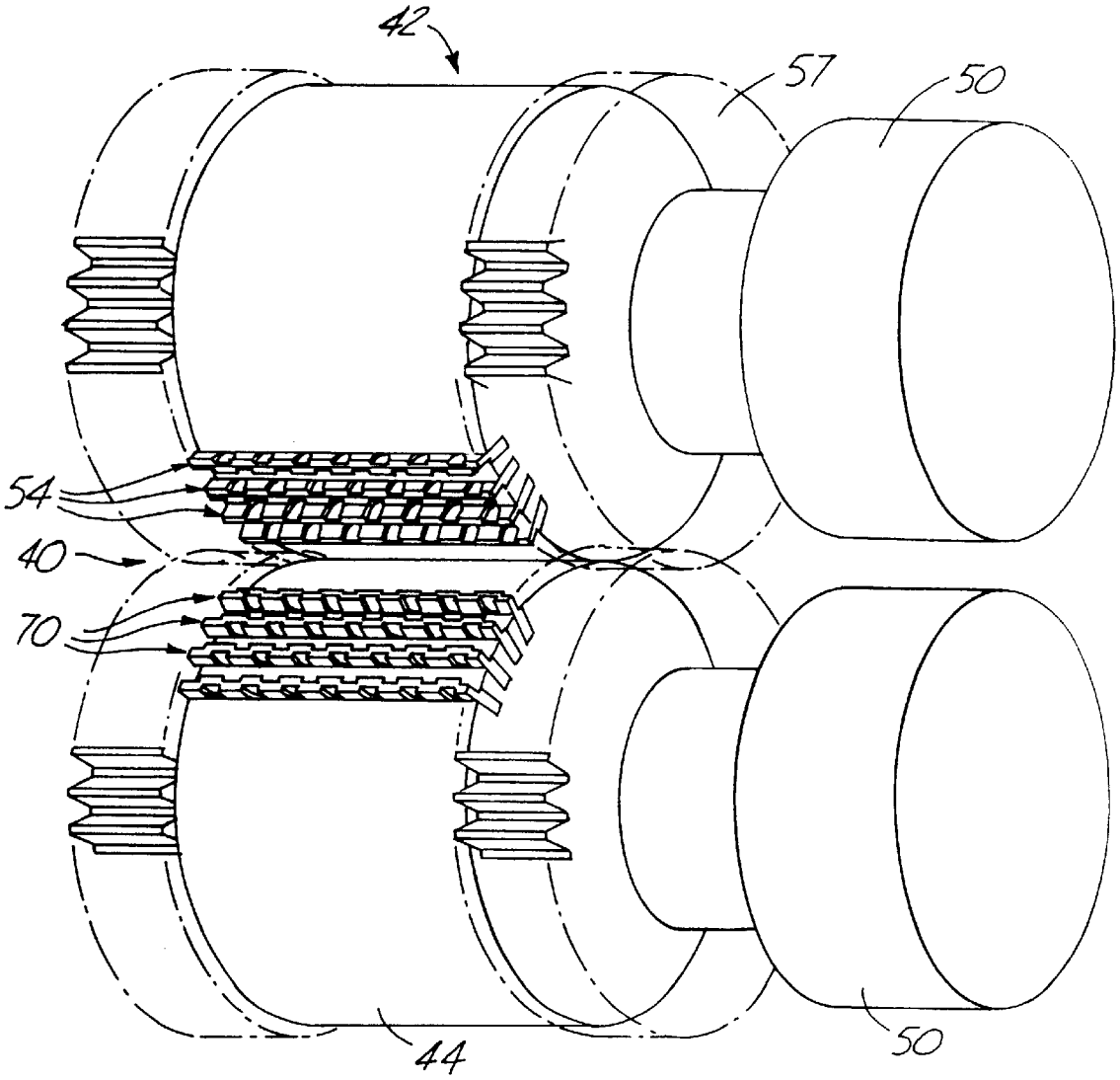
FIG. 4 is a prospective view of the rollers used in the slitting, opening and corrugation stage shown in FIG. 3.

FIGS. 3 and 4 show the shearing and corrugation stand 40 in greater detail. The shearing and corrugation stand 40 includes a first roller 42, a second roller 44, a frame (not shown) for mounting the first and second rollers 42 and 44, and a drive mechanism 49 for driving the first and second rollers 42 and 44.

Figures 5A, 5B, 5C, 6A, 6B, 6C:
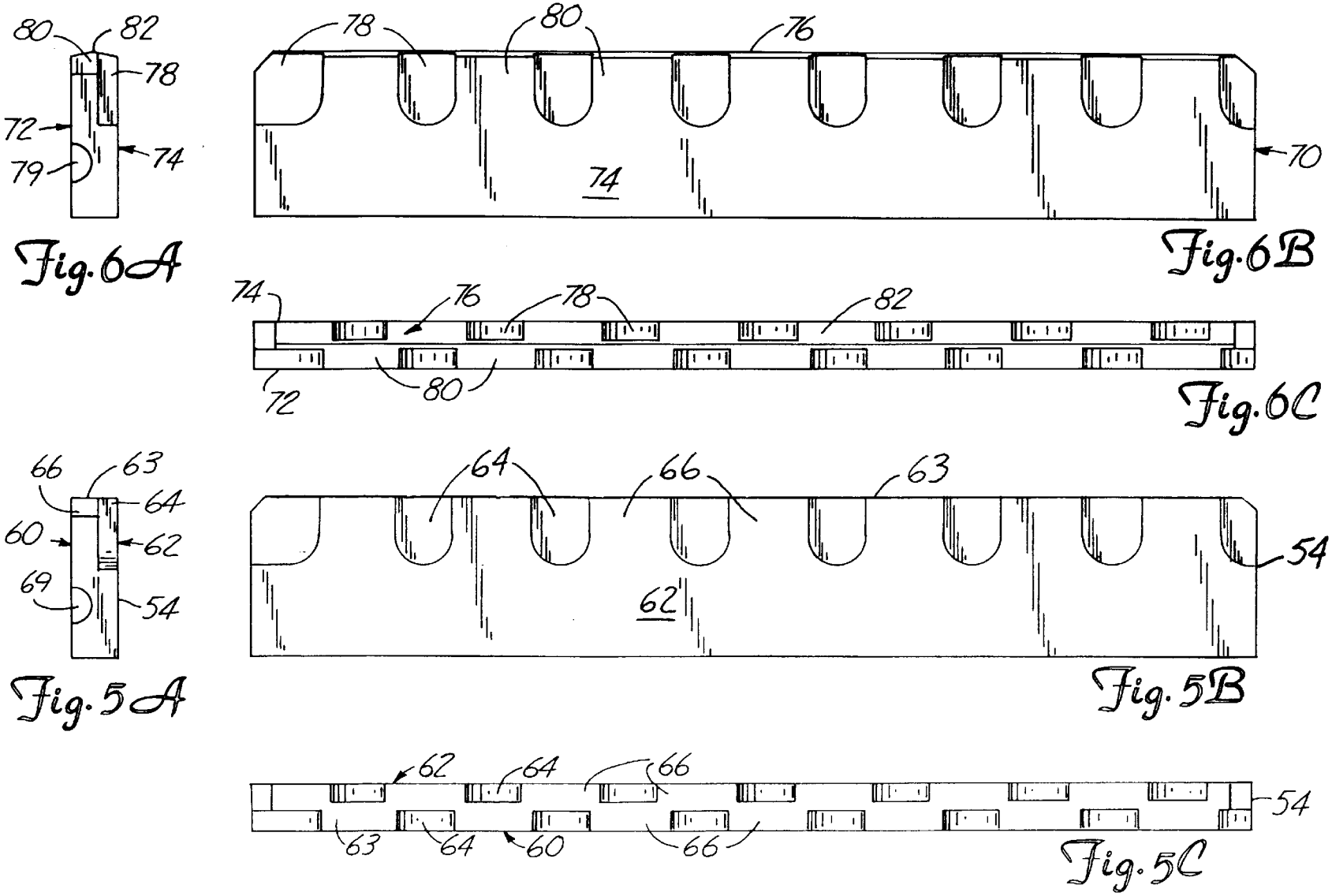
FIG. 5*a* is a side elevation of shear/corrugation blade for use in a first roller according to the present invention.
FIG. 5*b* is a top plan view of the blade shown in FIG. 5*a*.
FIG. 5*c* is an end view of the blade shown in FIG. 5*a*.
FIG. 6*a* is a side elevational view of a shear/corrugation blade of a second roller according to the present invention.
FIG. 6*b* is a top plan view of the blade shown in FIG. 6*a*.
FIG. 6*c* is an end view of the blade shown in FIG. 6*a*.

The first roller 42 includes a plurality of shear blades 54 which are shown in more detail in FIGS. 5*a*–5*c*. Each shear blade 54 is arranged transversely to the first roller 42 and parallel to each other around a periphery of the first roller 42. The first roler 42 is adjustably mounted so that the depth to which the teeth of the first and second rollers mesh may be varied. In addition, each of the shear blades 54 is equally spaced around the periphery of the first roller 42. This arrangement provides for a uniform formation of the ventilation slots 20 on the floor members 10.

Referring specifically to FIGS. 5*a*–5*c*, each of the plurality of shear blades 54 on the first roller 42 has a first side section 60, a second side section 62, and a top surface 63. The first and second side sections 60 and 62 each have recesses 64 therein to form shearing edges or teeth 66. The recesses 64 are U-shaped only because of the milling tool used to cut them, but can be of any suitable dimension and shape. The first side section 60 also has mounting holes 69 which are used to mount the shearing blade 54 in a radial groove on the first roller 42. The shearing edges 66 of the first and second side sections 60 and 62 on the first roller 42 are alternately displaced with respect to each other so that a shearing edge 66 on one section is arranged opposite to a recess 64 on the other section. The illustrated embodiment depicts the first side section 60 with seven (7) cutting edges 66 and eight (8) recesses 64 and the second side section 62 with eight (8) cutting edges 66 and seven (7) recesses 64. The top surface 63 of the shear blades 54 of the first roller 42 is flat. However, it is to be understood that the shape of the top surface 63 may be varied to suit particular design applications.

The second roller 44 also has a plurality of shear blades 70 which are shown in more detail in FIGS. 6*a*–6*c*. The shear blades 70 are arranged transversely to the second roller 44 and parallel to each other around a periphery of the second roller 44. In the illustrated embodiment the second roller 44 is fixed in the roll forming machine 26 so that the height of the shearing blades 70 is fixed and so only the first roller 42 is movable with respect to the second roller 44. Of course, this arrangement may be varied to suit the particular machine. The shear blades 54 and 70 of the first and second rollers 42 and 44 are arranged to mesh with each other to cut and open slots in sheet-metal strip 28 and at the same time provide the transverse corrugations in the strip 28.

Each of the plurality of shear blades 70 of the second roller 44 has a first side section 72, a second side section 74 and a top surface 76. The first and second side sections 72 and 74 each have recesses 78 therein to form shearing edges or teeth 80. The first side section 72 also has mounting holes 79 which are used to mount the shearing blade 70 in a radial groove on the first roller 44. The shearing edges 80 of the first and second side sections 72 and 74 are alternately displaced with respect to each other so that a shearing edge 80 on one section is arranged opposite to a recess 78 on the other section. The top surface 76 of the first and second side sections 72 and 74 of the second roller 44 includes an upwardly extending beveled or crowned surface 82. The beveled surface 82 rounds the peaks 22 of the floor member 10 to eliminate the sharp edges which usually form around the drilled or punched ventilation slots 20. The first and second rollers 42 and 44 preferably have an outer diameter of 6 to 8 inches and a length of approximately 10 inches, however these dimensions may vary depending on the application.

The drive mechanism 49 includes a motor force 50 applied to one or both of the rollers 42 and 44. In either case the first and second rollers have a gear arrangement 57 at the peripheral ends thereof to maintain the alignment and integrity of the first and second rollers 42 and 44 and the station 40. A guide roller (not shown) is also well known and is used at the edges of the first and second rollers 42 and 44 to keep the sheet-metal strip 28 on track through the shearing and corrugation stand 40. The guide roller may be provided to ride in the female support channel 14.

The sheet-metal strip 28 which is still flat in its central portion advances through the shearing and corrugation stand 40 at a rate of between 30 to 100 feet/minute. As the sheet-metal strip 28 proceeds through the shearing and corrugation stand 40, each tooth on the shearing blades 54 and 70 engages the sheet-metal strip 28 and cuts a slit. For a typical shearing action, it is desirable to maintain a clearance between the teeth of the shearing blades 54 and 70 of between 5% to 10% of the thickness of the strip 28 metal thickness as the teeth mesh together. As the teeth continue to mesh with each other, the slits are stretched open to form ventilation slots 20. Further meshing of the teeth of the shear blades 54 and 70 provides the transverse corrugations peaks and valleys 22 and 24 on the sheet-metal strip 28.

This single stage operation using the shearing teeth on the first and second roller 42 and 44 produces some stretching in the sheet-metal strip 28 which distorts the shape of the ventilation slots 20 on the floor members 10. The tight meshing of the shearing blades 54 and 70 allows them to shear, open and corrugate the strip 28 as shown in FIG. 3. By adjusting the depth that the shearing blades 54 and 70 enter each other, it is possible to control the height of the ventilation slots 20. By changing the shape of the top surface 76 of the shearing blades 70, it is also possible to adjust the height of the corrugations. This is desirable because smaller holes are necessary to keep smaller grains such as such rice from falling through the floor compared to larger openings which allow more air to flow for larger grains such as corn.

The ventilation slots 20 which are formed using the method and apparatus of the present invention have a more rectangular shape due to the dual shearing blades 54 and 70, compared to the elliptical shape of the prior art techniques such as is disclosed in the Simmons U.S. Pat. No. 4,418,558. The rectangular ventilation slots 20 of the present invention allow more open space for better air flow therethrough.

The floor members 10 manufactured by the method and apparatus of the present invention are characteristically quite strong, relative to the thickness and strength of the sheet-metal employed in fabrication, due to the combination of the arch and corrugated construction employed for in central floor portions 12 of the floor members. Furthermore, since no sheet-metal has been cut from the central floor portion 12, the substantial reduction in strength that occurs with punch perforation techniques is not encountered. At the same time, the cost of a perforating punch stand for the roll forming machine is eliminated, so that the method and apparatus of the invention result in a substantial economic benefit over the prior art punch perforation methods. Moreover, the shearing and corrugation stand 40 of the present invention accomplishes in one operation, the combined operation of the lancing stand and the corrugation stand described in the Simmons U.S. Pat. No. 4,418,558. The shearing and corrugation stand 40 of the present invention is more cost and space efficient than the prior techniques and provides a simpler and unique manufacturing technique over the state of the art. In addition, retrofitting of existing roll forming machinery now requires replacement of only one stand instead of two or more stands.

Although the present invention has been described with reference to preferred embodiments, workers skilled in the art will recognize that changes may be made in form and detail without departing from the spirit and scope of the invention.

What is claimed is:

1. A method of manufacturing interlocking sheet metal floor members for use in a grain storage bin or like application requiring passage of fluid through the floor members without permitting passage of granular material therethrough, the method comprising the acts of:

providing a first roller rotatable about a first roller axis, the first roller having a plurality of shearing blades extending radially outward and longitudinally around a periphery of the first roller, each shearing blade having a leading side, a trailing side and a top surface extending from the leading side to the trailing side with a plurality of leading shearing teeth defined by recesses which recede from the top surface into the leading side of the shearing blade and a plurality of trailing shearing teeth defined by recesses which recede from the top surface into the trailing side of the shearing blade;

providing a second roller rotatable about a second roller axis parallel to the first roller axis, the second roller having a plurality of shearing blades extending radially outward and longitudinally around a periphery of the second roller, each shearing blade having a leading side, a trailing side and a top surface extending from the leading side to the trailing side with a plurality of leading shearing teeth defined by recesses which recede from the top surface into the leading side of the shearing blade and a plurality of trailing shearing teeth defined by recesses which recede from the top surface into the trailing side of the shearing blade;

wherein the shearing blades of the first roller mesh between opposing shearing blades of the second roller such that leading shearing teeth of the first roller mate against opposing trailing shearing teeth of the second roller and such that trailing shearing teeth of the first roller mate against opposing leading shearing teeth of the second roller, with an entirety of the top surface of the shearing blade of the first roller extending past an entirety of the top surface of the opposing shearing blades of the second roller during meshing;

providing a metal sheet having a first side edge and an opposing second side edge with the central portion between the first side edge and the second side edge; and passing the metal sheet between the roller while rotating the rollers to shear and open rows of slits in the central portion of the metal sheet with mating shearing teeth of the first and second rollers, each of the slits running generally transverse relative to the first side edge and the second side edge, while simultaneously corrugating the metal sheet between opposing meshing shearing blades of the first and second rollers, such that corrugations run generally parallel relative to the slits and generally transverse relative to the first side edge and the second side edge, with valleys of the corrugations formed by the top surfaces of the shearing blades of the first roller and peaks of the corrugations formed by the top surfaces of the shearing blades of the second roller and with the slits formed between opposing shearing teeth of the first and second rollers located on the slopes of the corrugations.

2. The method of claim 1, wherein the top surface of each of the shearing blades of the second roller is crowned to form a peak of the corrugations.

3. The method of claim 1, wherein the top surface of each of the shearing blades of the first roller is crowned to form a valley of the corrugations.

4. The method of claim 1, further comprising the act of forming a first interlocking section on the first side edge of the metal sheet and a second interlocking section on the second side edge of the metal sheet, with the central portion of the metal sheet between the first interlocking section and the second interlocking section.

5. The method of claim 4, further comprising the act of cutting the metal sheet at selected transverse locations to form the sheet metal floor members, wherein the first interlocking section of one sheet metal floor member is connectible to the second interlocking section of another sheet metal floor member.

6. The method of claim 1, wherein the top surface of each of the shearing blades of the first roller is crowned to form a valley of the corrugations;

wherein the top surface of each of the shearing blades of the second roller is crowned to form a peak of the corrugations;

wherein the leading shearing teeth of each shearing blade of the first roller are staggered with respect to the trailing shearing teeth of said shearing blade, such that a leading tooth is opposite a recess of the trailing side;

wherein the leading shearing teeth of each shearing blade of the second roller are staggered with respect to the trailing shearing teeth of said shearing blade, such that a leading tooth is opposite a recess of the trailing side;

and further comprising the acts of:

forming a first interlocking section on the first side edge of the strip of sheet metal and a second interlocking section on the second side edge of the strip of sheet metal, with the central portion of the strip of sheet metal between the first interlocking section and the second interlocking section; and cutting the strip of sheet metal at selected transverse locations to form the sheet metal floor members, wherein the first interlocking section of one sheet metal floor member is connectable to the second interlocking section of another sheet metal floor member.

7. The method of claim 1, wherein the leading shearing teeth of each shearing blade are staggered with respect to the trailing shearing teeth of said shearing blade, such that a leading tooth is opposite a recess of the trailing side.

* * * * *